US007953343B2

(12) United States Patent
Kawamata

(10) Patent No.: US 7,953,343 B2
(45) Date of Patent: May 31, 2011

(54) AIR GUIDE MECHANISM AND IMAGE FORMING APPARATUS

(75) Inventor: Kunimasa Kawamata, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 107 days.

(21) Appl. No.: 12/538,426

(22) Filed: Aug. 10, 2009

(65) Prior Publication Data

US 2010/0034553 A1 Feb. 11, 2010

(30) Foreign Application Priority Data

Aug. 11, 2008 (JP) ..... P2008-207481

(51) Int. Cl.
*G03G 21/20* (2006.01)

(52) U.S. Cl. ..... 399/92

(58) Field of Classification Search ..... 399/92; 62/404; 454/309, 321
See application file for complete search history.

(56) References Cited

U.S. PATENT DOCUMENTS

| | | | | |
|---|---|---|---|---|
| 3,045,578 | A * | 7/1962 | McGrath | 454/321 |
| 5,612,768 | A * | 3/1997 | Kim et al. | 399/92 |
| 7,603,050 | B2 * | 10/2009 | Kim | 399/92 |
| 7,747,186 | B2 * | 6/2010 | Miyamoto et al. | 399/92 |

FOREIGN PATENT DOCUMENTS

| | | |
|---|---|---|
| JP | 11-327235 | 11/1999 |
| JP | 2006-154137 | 6/2006 |

* cited by examiner

*Primary Examiner* — Sandra L Brase
(74) *Attorney, Agent, or Firm* — Morgan, Lewis & Bockius LLP

(57) ABSTRACT

An air guide mechanism includes a box unit that incorporates a heating element therein; an air fan unit that is disposed within the box unit; and a guide unit that is disposed on a side of the box unit, wherein the guide unit guides the air to a portion of a round area formed due to the rotation of the vane portion from a first direction having an acute angle with respect to an inclination direction of the vane portion corresponding to the portion of the round area, and to an area, which is at least another portion of the round area and in which the first direction intersects at a non-acute angle with an inclination direction of the vane portion, from a second direction having a smaller angle than the non-acute angle.

8 Claims, 20 Drawing Sheets

AIR GUIDE MECHANISM AND IMAGE FORMING APPARATUS

CROSS-REFERENCE TO RELATED APPLICATION

This application is based on and claims priority under 35 USC 119 from Japanese Patent Application No. 2008-207481 filed on Aug. 11, 2008.

BACKGROUND

1. Technical Field

The present invention relates to an air guide mechanism and an image forming apparatus.

2. Related Art

For example, an image forming apparatus such as a copying machine and a printer employing an electro photonic system is structured such that, for example, electrostatic latent images formed on sensitive drums are developed by their associated developing devices (developing machines) using a developer to form toner images on the sensitive drums, and, the toner images formed on the sensitive drums are then transferred and fixed onto a recording medium conveyed from a sheet supply portion, thereby forming images.

In this type of image forming apparatus, in the box unit, there are incorporated various members (heating elements) such as a fixing device for generating heat when the apparatus is in operation. In view of this, there is provided an air suction fan (an air fan unit) which introduces the air into the box unit to cool the heating elements.

SUMMARY

According to an aspect of the invention, an air guide mechanism includes a box unit that incorporates a heating element therein; an air fan unit that is disposed within the box unit and has a vane portion which rotates to guide air; and a guide unit that is disposed on a side of the box unit against the air fan unit, wherein the guide unit guides the air to a portion of a round area formed due to the rotation of the vane portion from a first direction having an acute angle with respect to an inclination direction of the vane portion corresponding to the portion of the round area, and to an area, which is at least another portion of the round area and in which the first direction intersects at a non-acute angle with an inclination direction of the vane portion, from a second direction having a smaller angle than the non-acute angle.

BRIEF DESCRIPTION OF THE DRAWINGS

Exemplary embodiments of the invention will be described in detail based on the following figures, wherein.

DETAILED DESCRIPTION

Figure 1:
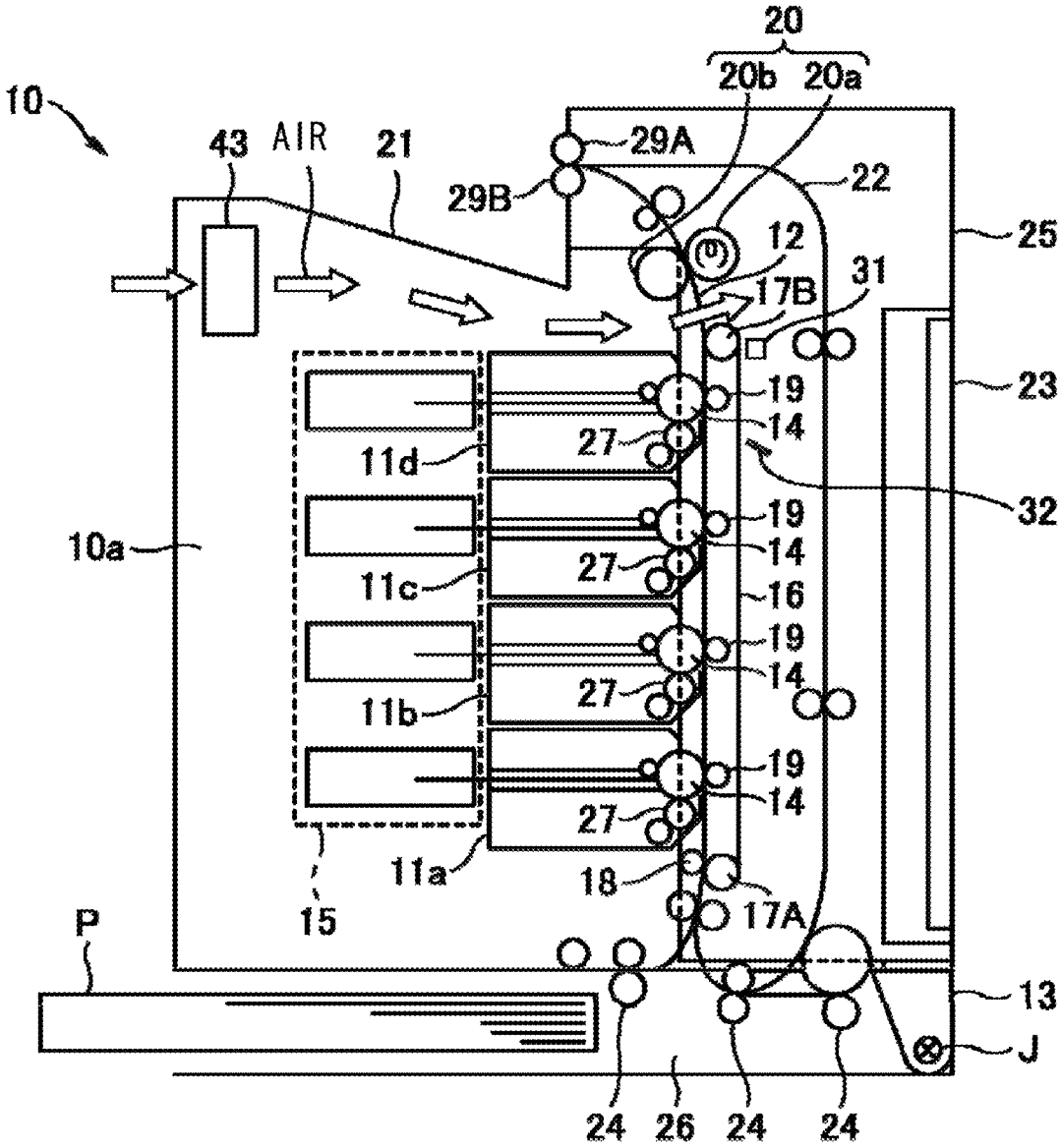
FIG. 1 is a schematic view of an image forming apparatus according to an exemplary embodiment of the invention.

Now, description will be given below in detail of an image forming apparatus according to an exemplary embodiment of the invention with reference to the accompanying drawings. Here, in the drawings used to explain the exemplary embodiment, the same composing elements are in principle given the same designations and thus the repeated description thereof will be omitted.

FIG. 1 is a schematic view of an image forming apparatus according to an exemplary embodiment of the invention.

An image forming apparatus 10 shown in FIG. 1 is a so called tandem type image forming apparatus structured such that, within a box unit 10*a*, there are arranged four process cartridges (image forming units or drum cartridges) 11*a*, 11*b*, 11*c* and 11*d* for four colors sequentially in the vertical direction. Also, in the portion of the box unit 10*a* to which the process cartridges 11*a*, 11*b*, 11*c* and 11*d* respectively correspond, there is arranged a convey route 12 along which a sheet (recording member) P is to be conveyed upwardly from below substantially in the vertical direction. And, further downwardly (upstream) of the process cartridge 11*a* in the lowermost stage (most upstream), there is arranged a sheet supply cassette 13 for storing the sheet P which is conveyed along the convey route 12 and onto which toner images are to be transferred sequentially.

According to the present exemplary embodiment, the sheet supply cassette 13 is structured such that a portion thereof can be projected toward the deep side (rear side, or inside) of the box unit 10*a* depending on the size of the sheet P to be stored into the sheet supply cassette 13. When the sheet P is small in size, a portion of the sheet supply cassette 13 will not be projected from the box unit 10*a*.

The process cartridges 11*a*~11*d* are used to form toner images respectively for yellow (Y), magenta (M), cyan (C) and black (K) in order starting from the upstream side of the convey route 12. To produce each of the process cartridges 11*a*~11*d*, a sensitive drum (image holding member) 14 and various electro photonic devices, which are sequentially arranged in the periphery of the sensitive drum 14, may be combined integrally into a cartridge. Here, as the electro photonic devices, there are available a charging roller for previously charging a sensitive drum 14, a developing device (heating element) 27 for developing an electrostatic latent image exposed and formed on the sensitive drum 14 charged by the charging roller using a corresponding one of toners, a cleaning device for removing the waste toner remaining on the sensitive drum 14, and the like.

On the opposite side of the convey route 12 for the process cartridges 11*a*~11*d*, there is disposed an exposure device 15 which is used in common with the process cartridges 11*a*~11*d*. This exposure device 15 drives and turns on four semiconductor lasers (not shown) according to the image data that corresponds to the respective colors. And, beams from the four semiconductor lasers are deflection scanned by a polygon mirror (not shown) and are then guided through an fθ lens (not shown) and multiple reflecting mirrors (not shown) to exposure points on the sensitive drum 14 to form a charge lost area on the sensitive drum 14 charged to a given potential, whereby there can be drawn electrostatic latent images.

In such portions of the process cartridges 11*a*~11*d* that respectively correspond to the sensitive drums 14, there is provided a convey belt 16 which can be circularly moved along the convey route 12. This convey belt 16 is made of a belt material capable of electrostatically attracting the sheet P and is provided over and between a drive roller 17A and a driven roller 17B which come as a pair. Also, on the convey route 12, there is provided an attracting roller 18 for electrostatically attracting the sheet P to the convey belt 16.

On the back surface side of the convey belt 16 corresponding to the respective sensitive drums 14 of the process cartridges 11*a*~11*d*, there are provided transfer rollers 19. The transfer rollers 19 are used to bring the sensitive drums 14 and the sheet P on the convey belt 16 into close contact with each other and also to transfer the toner images formed on the sensitive drums 14 to the sheet P.

On such portion of the convey route 12 that exists further upward (downstream) of the upper-most stage (most downstream) process cartridge 11*d*, there is provided a fixing device (heating element) 20. The fixing device 20 includes a heating roller 20*a* having a heat source and a pressurizing roller 20*b* which can be relatively pressure contacted with the heating roller 20*a*. When the sheet P with the toner images transferred thereto passes through the pressure contact area between the heading roller 20*a* and pressurizing roller 20*b* of the fixing device 20, the toner images can be fixed to the sheet P due to the heat and pressurizing force.

On the upper portion of the box unit 10*a*, there are provided a convey guide (not shown) for guiding the sheet to which the toner images have been fixed by the fixing device 20, sheet discharge rollers 29A and 29B respectively for discharging the sheet guided by the convey guide, and a sheet discharge portion 21 which is formed integrally with the box unit 10*a* and is used to store therein the sheet discharged by the sheet discharge rollers 29A and 29B. Also, in the box unit 10*a*, there is disposed a reversing convey route 22 along which the front and back sides of the sheet P with one side thereof fixed by the fixing device 20 are reversed and the sheet P is then fed again to the convey route 12.

Here, on the upper portion of the convey belt 16, there are provided: an ADC sensor 31 which is made of a reflecting type photo sensor for detecting the density of a toner patch mark formed on the convey belt 16 and also for adjusting the toner density; a cleaner 32 which can be contacted with the surface of the convey belt 16 on the downstream side of the convey belt 16 of the ADC sensor 31 to clean the surface of the convey belt 16; and, a collecting portion for collecting toners and the like removed from the surface of the convey belt 16 by the cleaner 32.

Within the box unit 10*a* of the image forming apparatus 10, there is disposed an air suction fan (air fan unit) 43. This air suction fan 43 is situated on the upper right side of the box unit 10*a* when the air suction fan 43 is viewed from the front thereof. And, the air suction fan 43 is used to take in the air from externally of the apparatus and supply the air into the inside of the apparatus 10. The air taken in by the air suction fan 43 is used to cool the respective portions of the inside of the apparatus.

Figure 2:
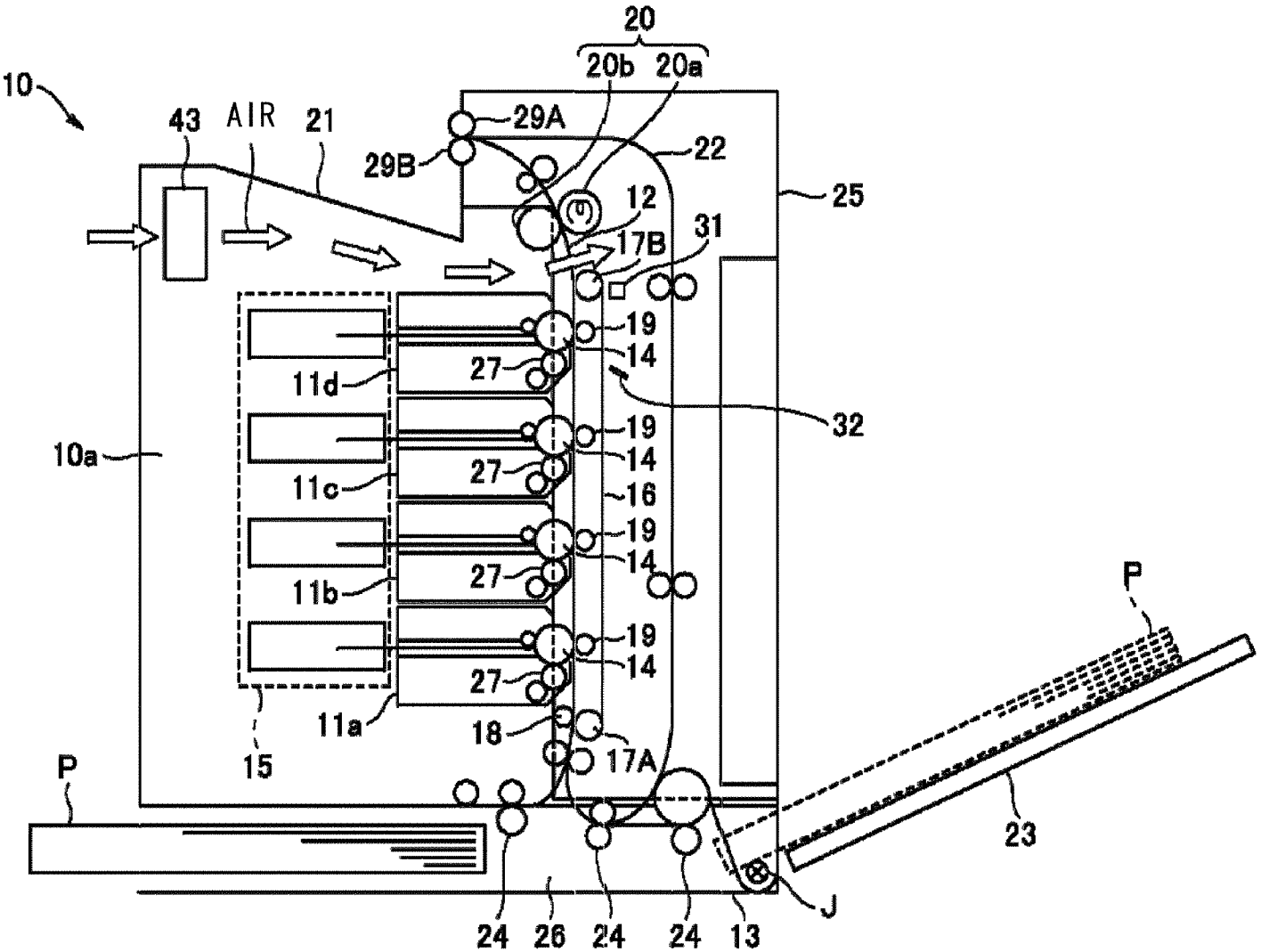
FIG. 2 is an explanatory view of a hand-operated tray.

FIG. 2 is a view to explain a hand-operated tray 23.

As shown in FIG. 2, the box unit 10*a* of the image forming apparatus 10 includes a hand-operated tray 23 which can be rotated about a rotation fulcrum J provided on the lower end thereof. That is, this hand-operated tray 23 is structured such that it can be opened and closed toward this side (front side; or, outer side). When the hand-operated tray 23 is rotated in a direction to open it, a desired sheet P can be set in an insertion window (sheet supply opening) (not shown). In this manner, the image forming apparatus 10 is structured such that other sheet P than the sheet P stored in the sheet supply cassette 13 can be supplied from the hand-operated tray 23.

Here, in a state where a sheet P, to which toner images are to be transferred, is set, when an instruction is given to a control unit (not shown) from a user, one of the sheet P of the sheet supply cassette 13 and the sheet P of the hand-operated tray 23 is fed out at a given timing. And, the thus fed-out sheet P is conveyed through multiple convey rollers 24 to the convey route 12 and is then fed through the convey belt 16 into the respective transfer positions of the process cartridges 11*a*~11*d*.

Figure 3:
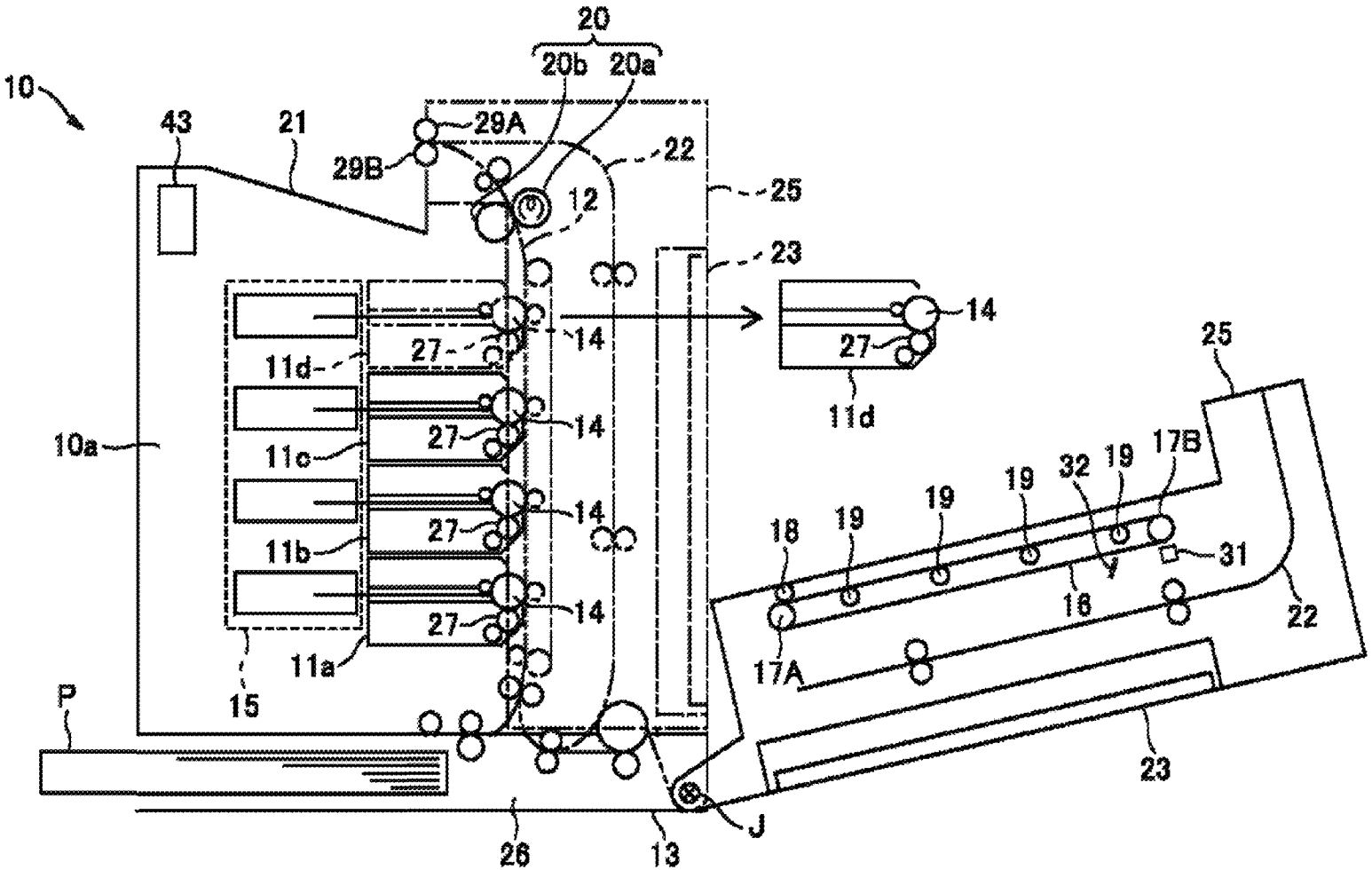
FIG. 3 is an explanatory view of a front cover.

FIG. 3 is a view to explain a front cover 25.

As shown in FIG. 3, the box unit 10*a* of the image forming apparatus 10 includes a front cover 25 which can be rotated about the rotation fulcrum J provided on the lower end thereof. The front cover 25, in a state where it is closed, functions as an outer cover together with the box unit 10*a*. That is, the front cover 25 constitutes a side wall portion which is situated upwardly of the sheet supply cassette 13 and on this side of the image forming apparatus 10.

On the front cover 25, there are mounted the convey belt 16, drive roller 17A, driven roller 17B, attracting roller 18, transfer rollers 19 and reversing convey route 22. Therefore, when the front cover 25 is opened, these parts are moved away from the box unit 10*a* side. In other words, when the front cover 25 is opened, the process cartridges 11*a*~11*d* are exposed, whereby a user is easy to access the convey route 12.

Here, the process cartridges 11*a*~11*d* are respectively removably mounted on the box unit 10*a* substantially in the horizontal direction. Owing to this structure, when the front cover 25 of the box unit 10*a* is opened, the mounting and removing operations of the process cartridges 11*a*~11*d* can be realized. Also, a set detecting sensor (not shown) detects the set states of the respective process cartridges 11*a*~11*d* and outputs the detection results to a control unit (not shown).

In this manner, by opening the front cover 25, the process cartridges 11*a*~11*d* can be exposed and replaced. Also, when the sensitive drums 14 are exposed, a sheet clog state can be dealt with (a sheet jam can be cleared). That is, the maintenance of the image forming apparatus 10 can be enhanced in this manner.

Figure 4:
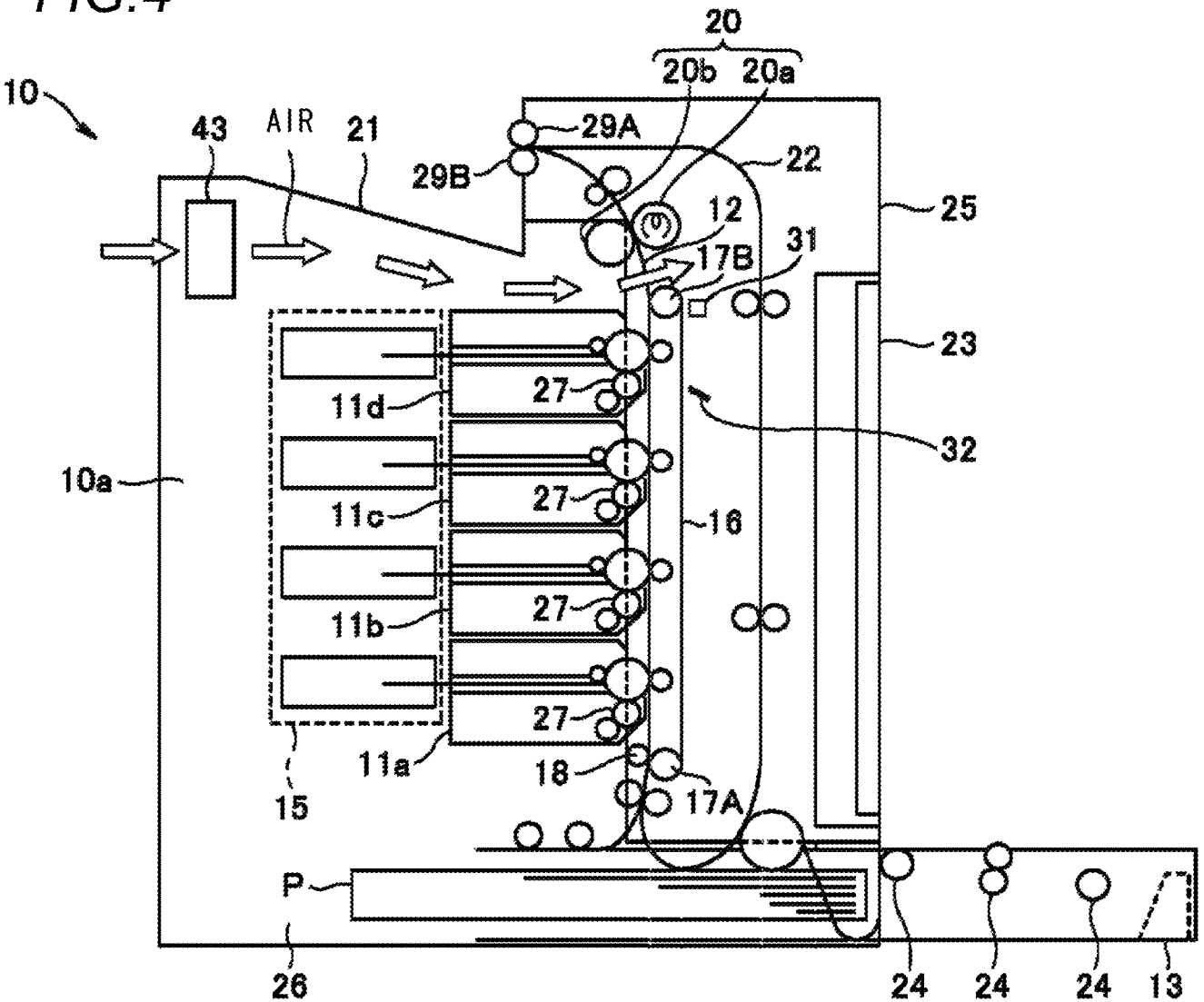
FIG. 4 is a view to explain how to draw out a sheet supply cassette.

FIG. 4 is a view to explain how to draw out the sheet supply cassette 13.

The sheet supply cassette 13 is stored in a cassette storage portion 26 provided in the box unit 10*a* and can be drawn out from this side of the box unit 10*a*. More specifically, in a state where the hand-operated tray 23 and front cover 25 are closed, the sheet supply cassette 13 can drawn out and inserted into the cassette storage portion 26.

And, in the sheet supply cassette 13, there is formed an insertion window (not shown) in which the sheet P for the hand-operated tray 23 can be set. Also, in the sheet supply cassette 13, there are disposed the partial portions of the multiple convey rollers 24 which are used to convey the sheet P for the hand-operated tray 23. In this manner, in the sheet supply cassette 13, there is formed a feed-out route along which the sheet P set in the insertion window (not shown) can be fed to the convey route 12.

Figure 5:
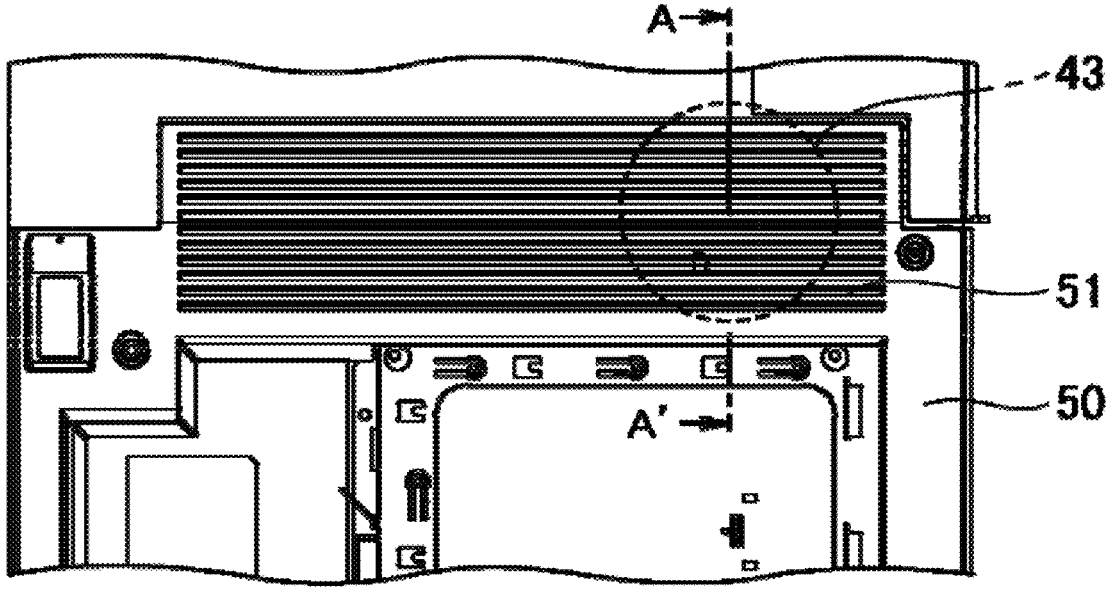
FIG. 5 is a front view of the appearance of an image forming apparatus when it is viewed from the deep side thereof.
Figure 6:
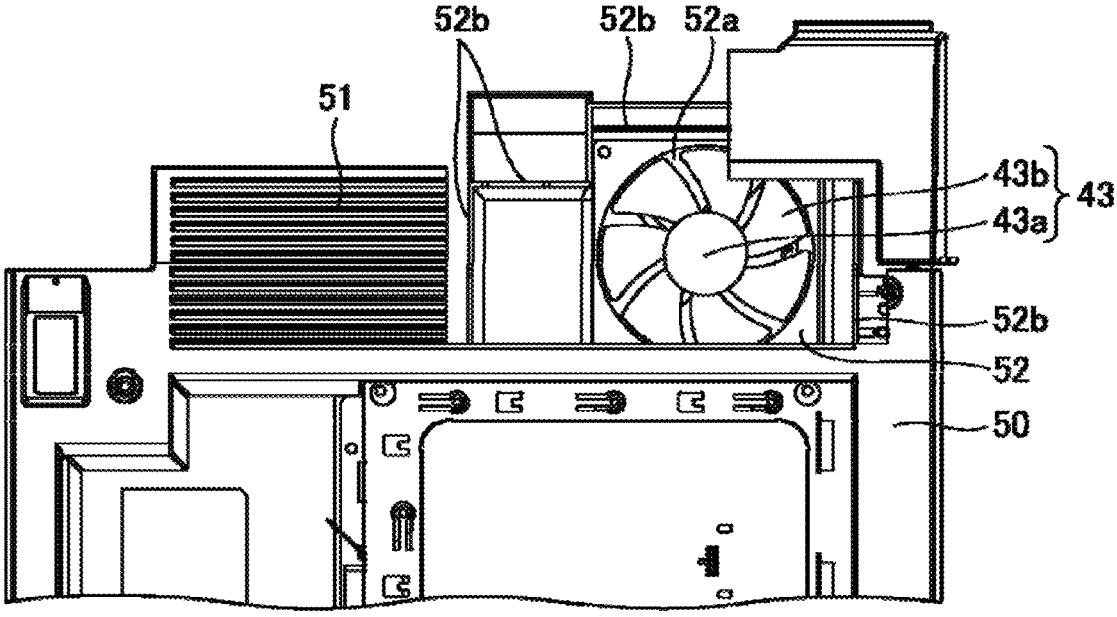
FIG. 6 is a front view of the appearance of the image forming apparatus when it is viewed from the deep side thereof, while composing members disposed in front of the air suction fan are omitted.
Figure 7:
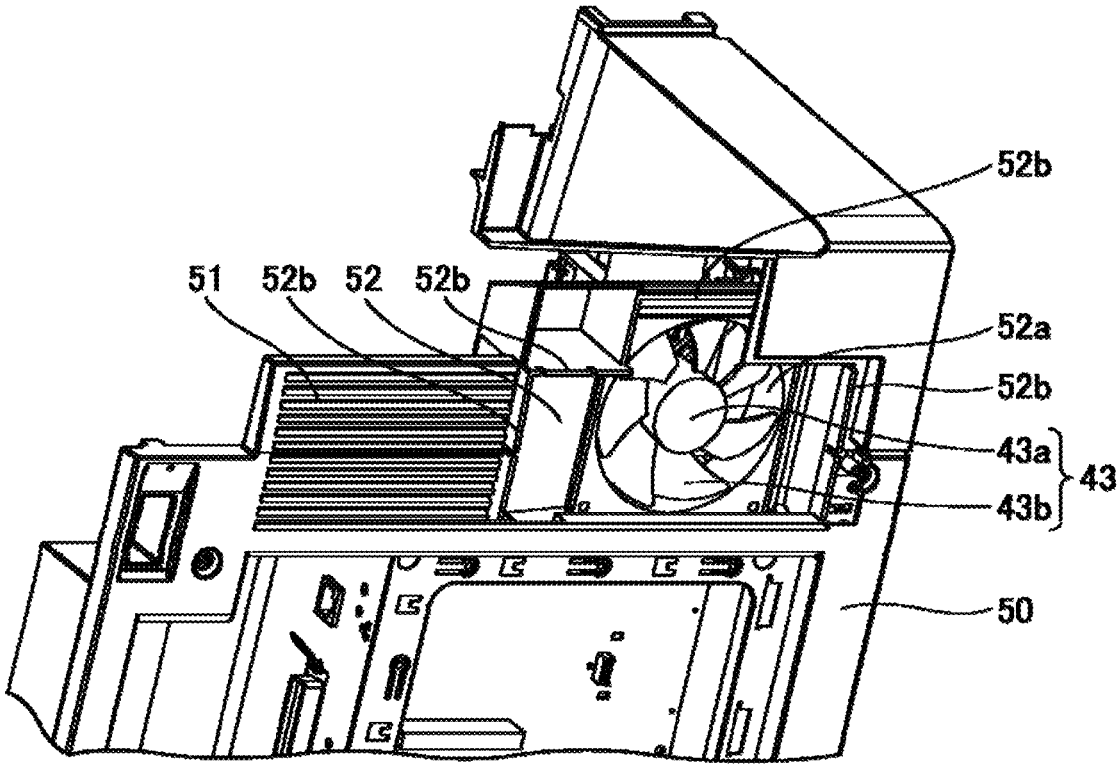
FIG. 7 is a perspective view of the appearance of the image forming apparatus when it is viewed from the deep side thereof, while composing members disposed in front of the air suction fan are omitted.

FIG. 5 is a front view of the image forming apparatus 10, showing the appearance of the apparatus when it is viewed from the deep side thereof; FIG. 6 is a front view of the image forming apparatus 10, showing the appearance of the apparatus when it is viewed from the deep side thereof, while parts situated in front of the air suction fan 43 are omitted; and, FIG. 7 is a perspective view of the image forming apparatus 10, showing the appearance of the apparatus when it is viewed from the deep side thereof, while parts situated in front of the air suction fan 43 are omitted.

As shown in these drawings, on the right upper portion of the box unit 10*a*, there is disposed the air suction fan 43 which is used to introduce the air into the box unit 10*a*. Also, in front of the air suction fan 43, there are provided louvers (introduction members for first and second guide portions) 51 which are formed integrally with a back surface plate 50 to be screwed to the box unit 10*a*, and also which include multiple horizontally extending slits arranged in the vertical direction. These louvers 51, when the air suction fan 43 is rotated, allow the air to be introduced through the slits into the box unit 10*a* and also prevent foreign matter or dust from going into the box unit 10*a*. Further, the louvers 51 prevent a user from touching the rotating air suction fan 43 carelessly. Here, the louvers 51 are disposed substantially over the whole width of the box unit 10*a* including such portion that exists in front of the air suction fan 43.

The air sucked in by the air suction fan 43 is allowed to pass through a ventilation route formed within the box unit 10*a* and is then sent to the developing devices 27 of the process cartridges 11*a*~11*d* and to the fixing device 20; and, after the air cools these devices, it is discharged to the outside through a discharge opening (not shown).

Here, each of the developing devices 27 receives the influence of heat from, for example, an exposure lamp and a charging lamp respectively arranged in the vicinity thereof Also, in the developing device 27, when a developer is stirred up in the inside of the device, due to the friction heat of carriers, the housing of the developing device 27 and developer within the device 27 are heated. And, when the developing device 27 is heated more than necessary, poor charging can be generated in the developer, or the toner can be influenced by the heat and can be thereby hardened. Also, the lowered fluidity of the toner can provide an obstacle to the forming action of the toner image. To solve such problems, the developing device 27 is also cooled.

Here, as shown in FIG. 7, the air suction fan 43 includes a boss portion 43*a* mounted on the rotation shaft of a motor (not shown) and multiple vane portions 43*b* (in the present exemplary embodiment, seven vane portions) respectively formed integrally with the boss portion 43*a*. And, according to the exemplary embodiment, each vane portion 43*a* is formed in such a shape that, when the air suction fan 43 is rotated counterclockwise, can introduce the air. Here, in the invention, the number of vane portions 43*b* may be any number (one or two or more), and the vane portion 43*b* may also have such a shape that, when rotated clockwise, can introduce the air.

Into the periphery of the air suction fan 43, there is fitted a plate 52 having a round opening 52*a* for avoiding interference with the rotation of the vane portions 43*b*. As shown in FIG. 7, the plate 52 has a shape the left portion of which is so inclined as to spread laterally, and the area of the left portion of the plate 52 is larger than that of the right portion thereof. And, not the rotation area of the air suction fan 43 (more specifically, the vane portions 43*b* thereof) but an area, which is wider than this rotation area and is defined by the plate 52, is used as an area for sucking the air of the air suction fan 43, thereby being able to secure a larger amount of air to be sucked.

On the outer peripheral portion of the plate 52, there are provided ribs 52*b* which respectively face outwardly (in the illustrated case, they extend toward this side). The ribs 52*b* separate the above-mentioned the air sucking area of the air suction fan 43 defined by the plate 52 and the internal space of the box unit 10*a* from each other. This prevents the high temperature air within the box unit 10*a* from mixing into the suction side air and thus prevents the cooling efficiency from being worsened.

Next, description will be given below of the guide portion that is arranged on the box unit 10*a* side with respect to the air suction fan 43.

Figure 8:
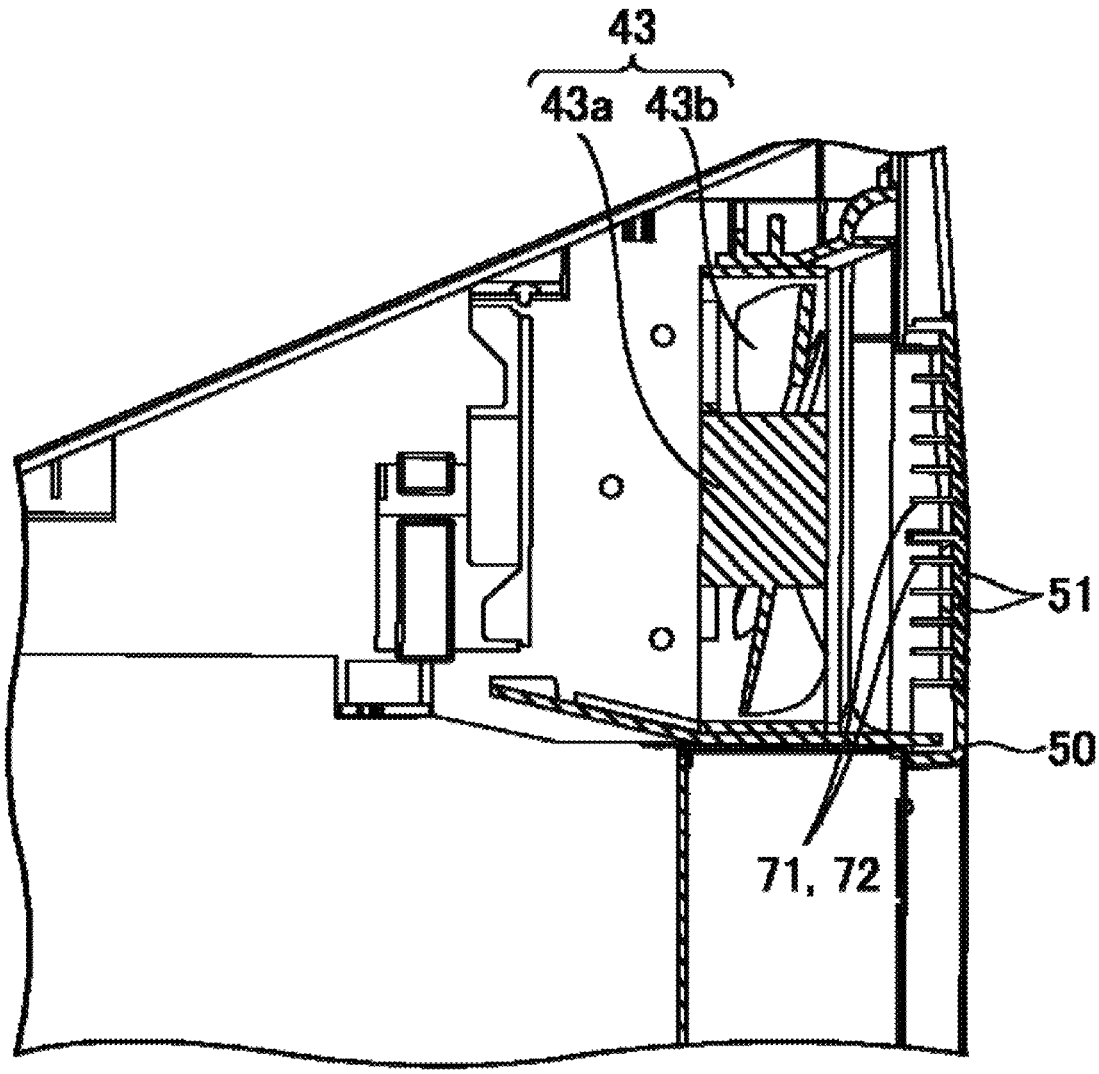
FIG. 8 is a section view taken along the A-A' line shown in FIG. 5.
Figure 9:
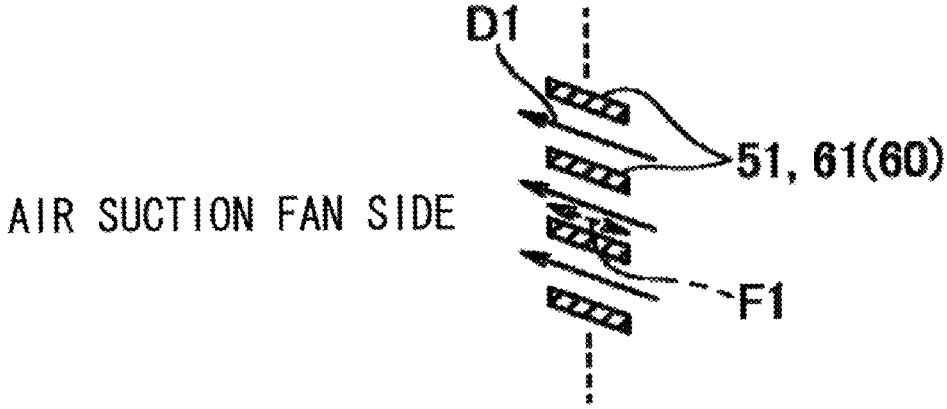
FIG. 9 is a section view of a first guide portion constituting a guide unit.
Figure 10:
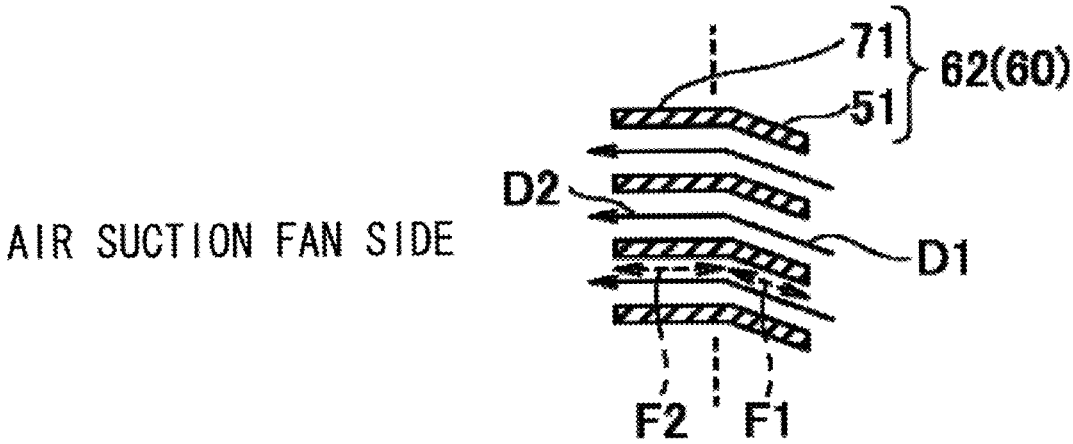
FIG. 10 is a section view of a second guide portion constituting the guide unit.
Figure 11:
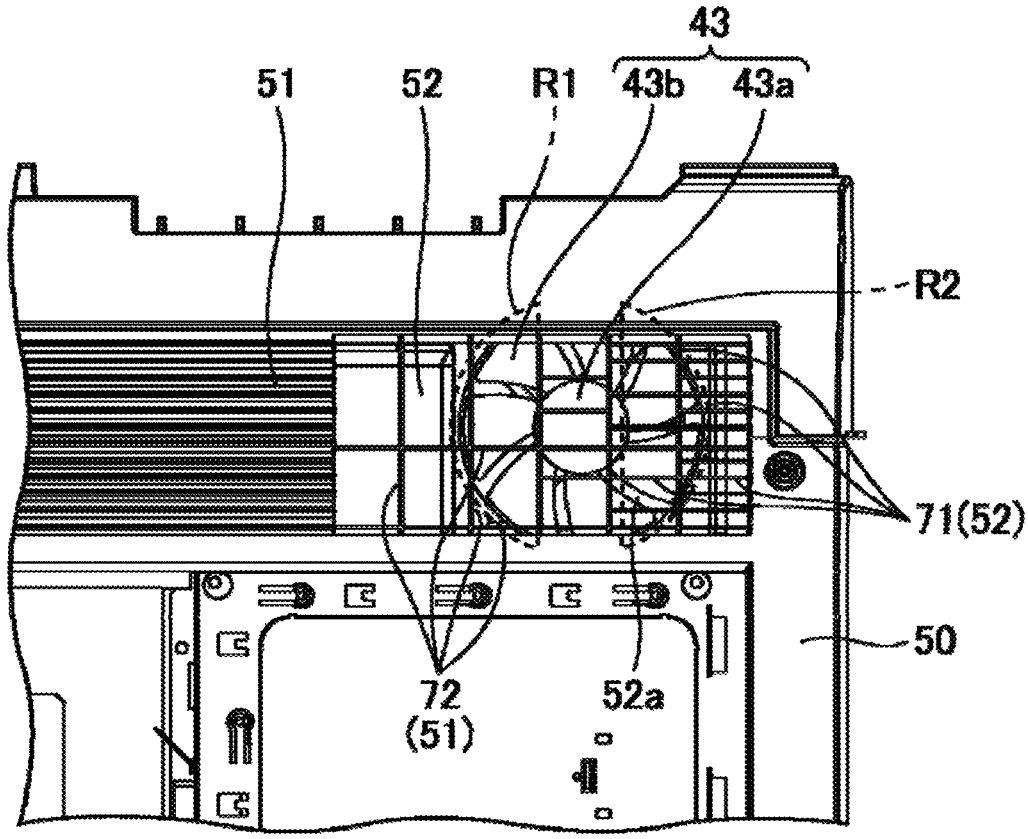
FIG. 11 is a front view of the appearance of the image forming apparatus when it is viewed from the deep side thereof, while ribs disposed in front of the air suction fan are extracted.
Figure 12:
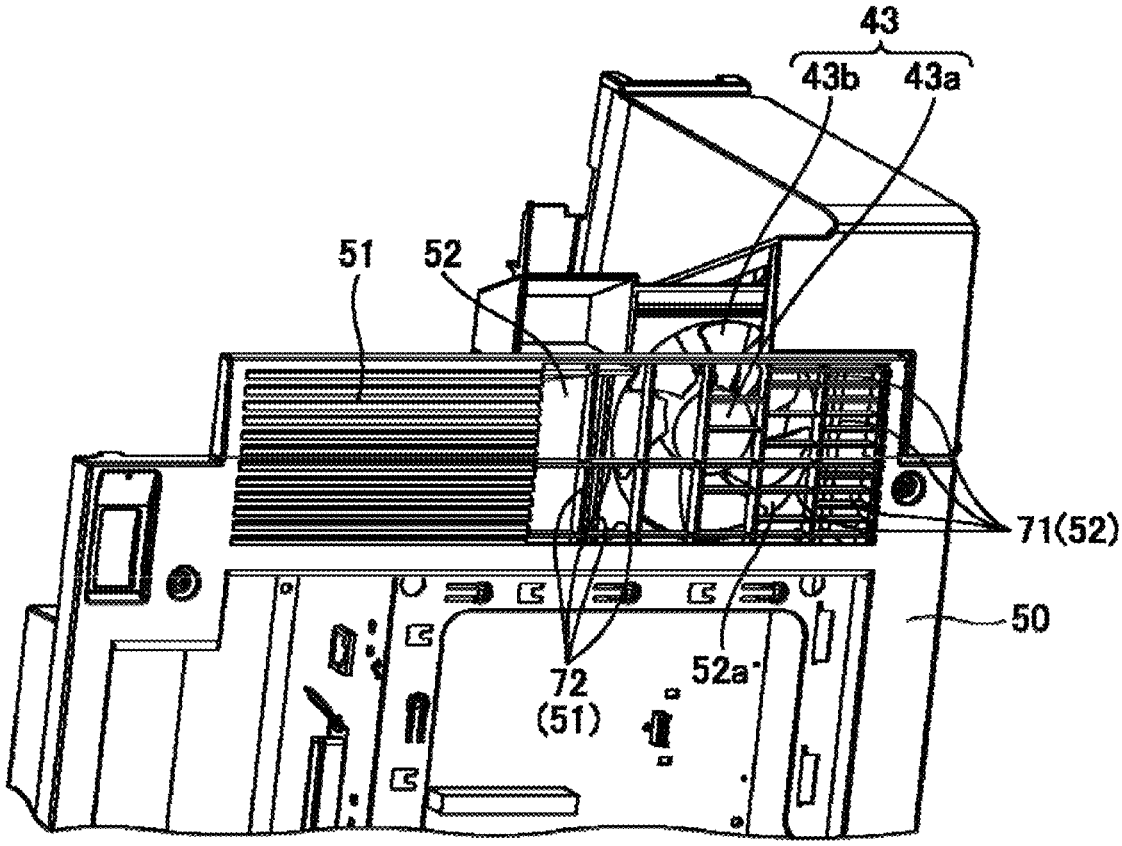
FIG. 12 is a perspective view of the appearance of the image forming apparatus when it is viewed from the deep side thereof, while the ribs disposed in front of the air suction fan are extracted.

Here, FIG. 8 is a section view taken along the A-A' line shown in FIG. 5; FIG. 9 is a section view of a first guide portion 61 which constitutes a guide unit 60; FIG. 10 is a section view of a second guide portion 62 constituting the guide unit 60; FIG. 11 is a front view of the image forming apparatus 10, showing the appearance thereof when viewed from the deep side thereof, while there are extracted ribs (change members, dividing members) 71 and 72 which are respectively disposed in front of the air suction fan 43; and, FIG. 12 is a perspective view of the image forming apparatus 10, showing the appearance thereof when viewed from the deep side thereof, while there are extracted ribs (change members, dividing members) 71 and 72 which are disposed in front of the air suction fan 43.

Figure 14:
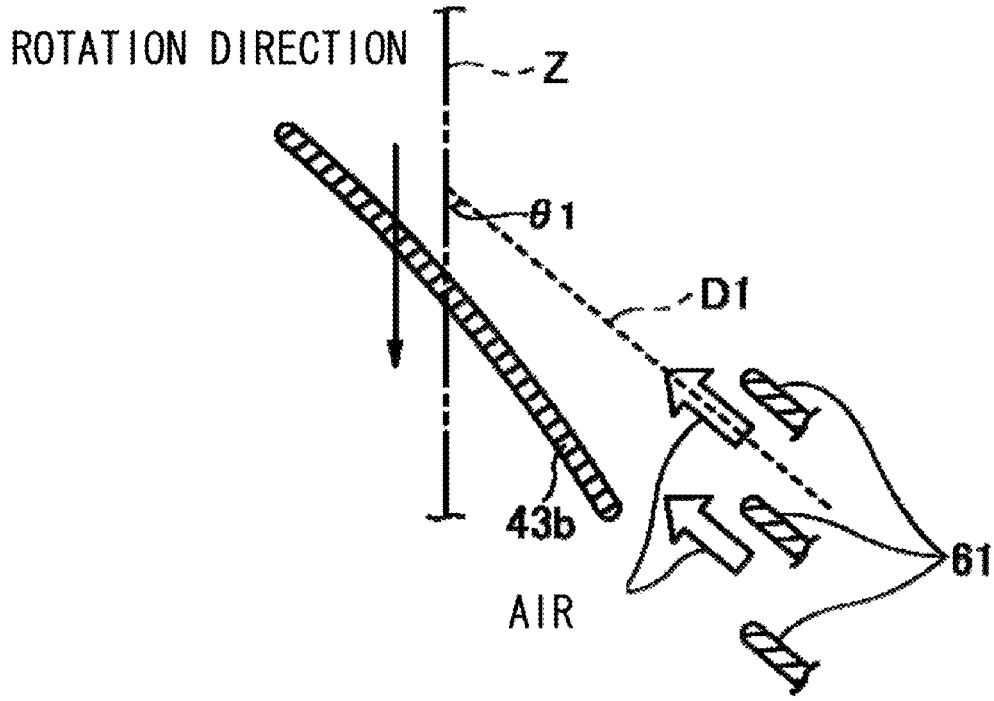
FIG. 14 is an explanatory view of the current of the air to be guided to a vane portion in a first area by the first guide portion according to the present exemplary embodiment.
Figure 15:
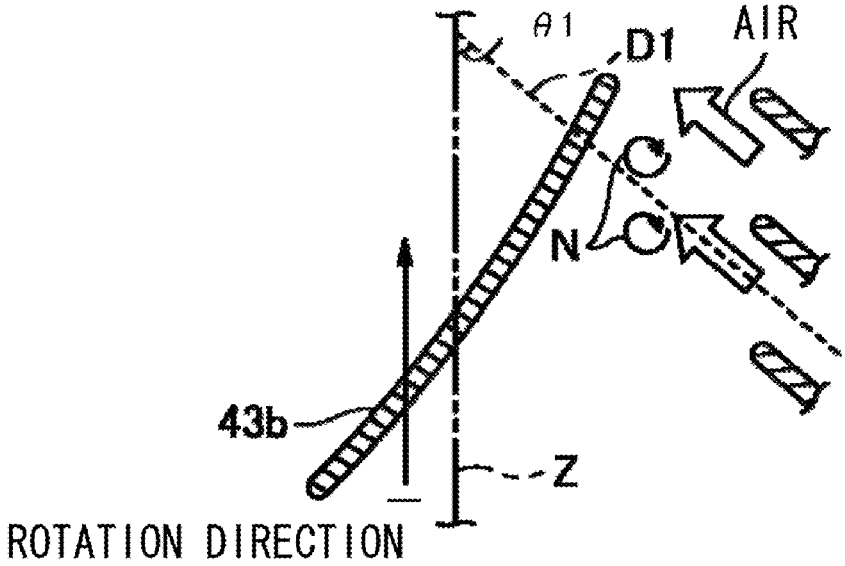
FIG. 15 is an explanatory view of the current of the air to be guided to a vane portion in a second area by a second guide portion according to a comparison example.
Figure 16:
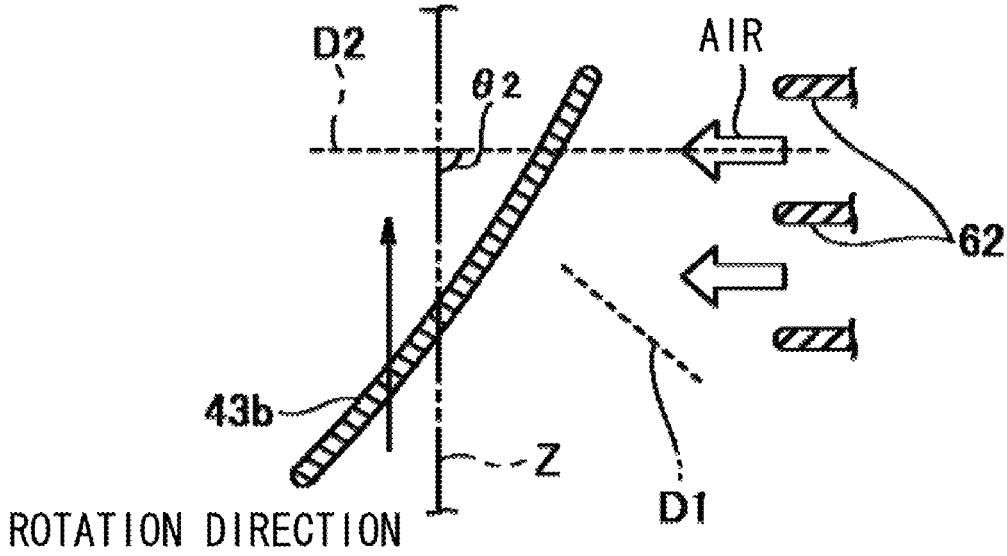
FIG. 16 is an explanatory view of the current of the air to be guided to a vane portion in a second area by a second guide portion according to the present exemplary embodiment.
Figure 17:
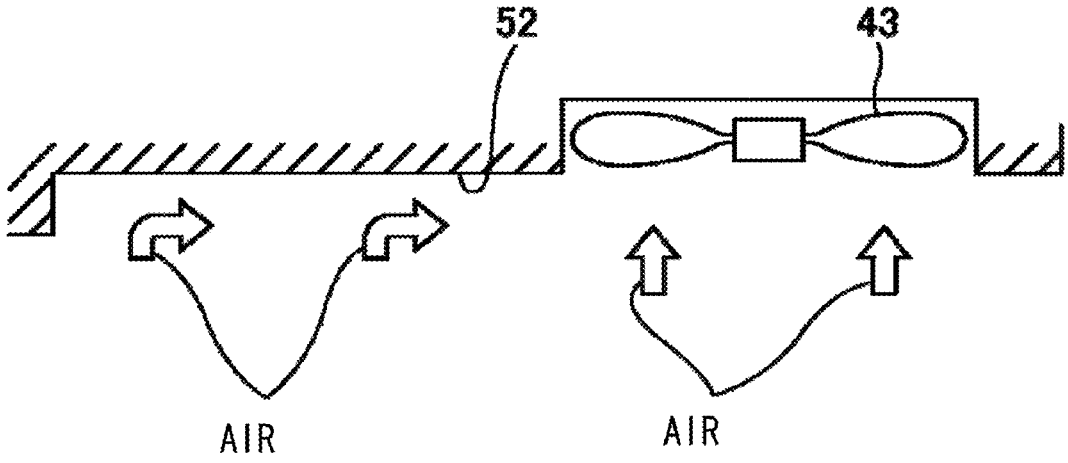
FIG. 17 is an explanatory view of the currents of two kinds of air respectively taken in at the position of an air suction fan and at the position of a plate fitted into the periphery of the air suction fan.

Also, FIG. 14 is an explanatory view of the current of the air when the first guide portion 61 guides the air to the vane portion 43*b* in a first area R1 according to the present exemplary embodiment; FIG. 15 is an explanatory view of the current of the air when the second guide portion 62 guides the air to the vane portion 43*b* in a second area R2 according to a comparison example; and, FIG. 16 is an explanatory view of the current of the air when the second guide portion 62 guides the air to the vane portion 43*b* in a second area R1 according to the present exemplary embodiment.

In the present exemplary embodiment, the guide unit 60 disposed on the box unit 10*a* side with respect to the air suction fan 43 includes the first guide portion (FIG. 9) composed of the above-mentioned louvers (introduction member) 51 each having an introduction route F1 extending in a first direction D1 corresponding to the current of the air guided upwardly from below, and the second guide portion (FIG. 10) composed of the louvers 51 and ribs (change member) 71, while each rib 71 is disposed on the air suction fan 43 side of its associated louver 51 and forms a change route F2 for changing the direction of the air, which is introduced toward a first direction D1 by the introduction route F1 of the louver 51, to a second direction D2.

Here, when a reference sign "Z" (FIGS. 14~16) is used to express a virtual plane which intersects at right angles with the rotation shaft of the air suction fan 43 and passes through an area to be formed when the vane portions 43*b* of the air suction fan 43 are rotated, the change route F2 of the second guide portion 62 changes the current of the air to a second direction D2 which is substantially at right angles to the virtual plane Z.

Figure 13:
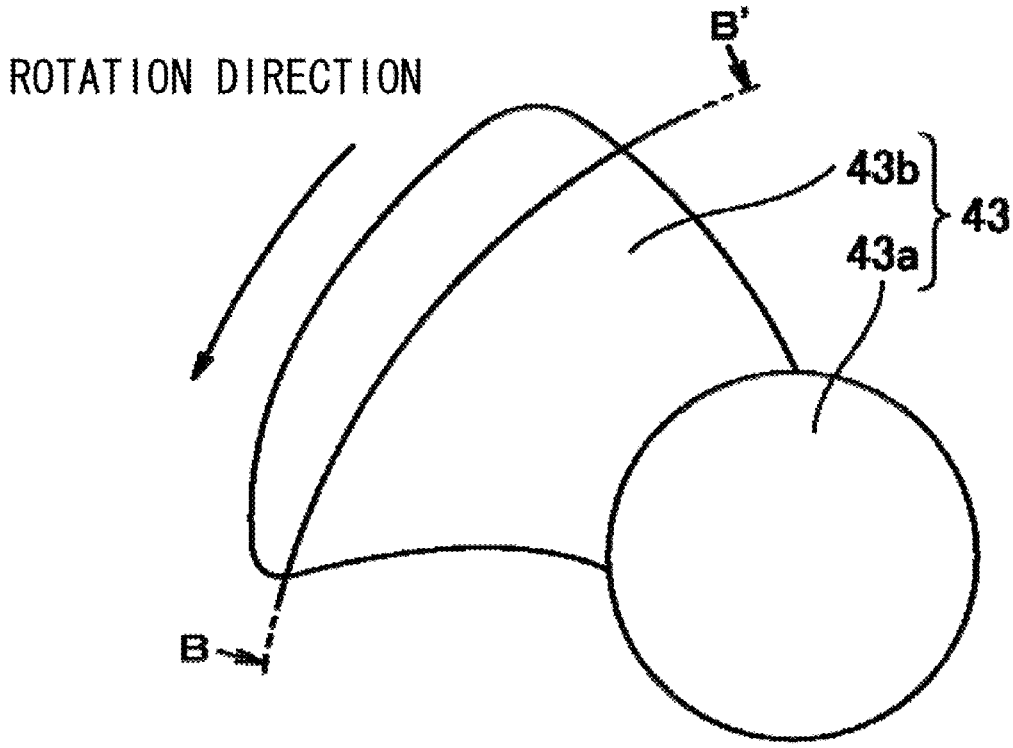
FIG. 13 is an explanatory section view of a streamlined vane shape of a vane portion.

And, the first guide portion 61 guides the air to a first area R1 (in the air suction fan 43 according to the present exemplary embodiment where the vane portion 43*b* is formed to have a shape to allow the introduction of the air when the vane portion 43*b* is rotated counterclockwise, to the left side, when viewed from this side, of the rotation area of the suction fan 43 in FIG. 11) of the rotation area (a round area which is formed when the vane portion 43*b* is rotated) of the air suction fan 43, from the above-mentioned first direction D1 which provides an acute angle to the inclination direction {in other words, the inclination direction of a streamline vane section (a section extending along the B-B' line shown in FIG. 13)} of the vane portion 43*b* opposed to this first area R1. Also, the second guide portion 62 guides the air to the second area R2, which is the other remaining area of the rotation area of the air suction fan 43 than the first area R1 and also in which the first direction D1 intersects at a non-acute angle with the inclination angle of the vane portion 43*b*, from a second direction D2 having a smaller angle than the non-acute angle.

As shown in FIG. 14, in the first area R1, since the first direction D1 provides acute angle to the inclination direction of the vane portion 43*b*, the air is taken in by the rotating vane portion 43*b* in such a manner that the air is cut in. This can prevent the generation of the disorder of the air (turbulent flow of the air) which causes the air cutting noise.

On the other hand, in the second area R2 as well, when the air is introduced from the first direction D1, as shown in FIG. 15, a portion of the air is flipped by the rotating vane portion 43*b*, thereby generating the turbulent flow N which causes the air cutting noise.

However, according to the present exemplary embodiment, as shown in FIG. 16, in the second area R2, due to the ribs 71 provided on the second guide portion 62, the direction of the air provides a second direction D2 which is substantially perpendicular to the above-mentioned virtual plane Z. That is, when the angle of the first direction D1 on the acute angle side thereof with respect to the virtual plane Z in the first area R1 is expressed as θ1, an angle θ2 of the second direction D2 with respect to the virtual plane Z in the second area R2 (the angle θ2 provided on the same side as the first direction D1) is larger than the angle θ1.

When this is viewed from the inclination direction of the vane portion 43*b*, an area, in which the first direction D1 intersects at a non-acute angle with the inclination direction of the vane portion 43*b*, is the second area R2; and, therefore, in the second area R2, a direction having a smaller angle than the non-acute angle provides the second direction D2.

This makes it hard for the air to be flipped by the rotating vane portion 43*b*, whereby the generation of the turbulent flow N can be reduced and thus the air cutting noise by the air suction fan 43 can be reduced. Therefore, according to an air guide mechanism having a structure according to the present exemplary embodiment, when the image forming apparatus is in an operation waiting time, even if only the air suction fan 43 is rotating, the air cutting noise is reduced to thereby provide a comfortable environment.

That is, when the image forming apparatus is executing an image forming operation, the noises, which are produced by movable members such as a motor, roller and gear, prevail. However, in the waiting time when the image forming operation is completed and thus the operations of the movable members are stopped, there prevails the air cutting noise generated by the air suction fan 43 which is used to introduce the air into the box unit 10*a*.

And, in the air guide mechanism according to the present exemplary embodiment, as described above, the air cutting noise produced by the rotation of the air suction fan 43 in the wait time of the image forming apparatus is reduced to thereby provide a comfortable environment.

Especially, when the image forming apparatus is reduced in size, the distance between the air suction fan 43 and guide unit 60 is decreased and thus the air cutting noise tends to increase. In view of this, use of such air guide mechanism as in the present exemplary embodiment can be said to be advantageous.

Also, according to the present exemplary embodiment, since the louvers 51 are added to the ribs 71 to thereby allow the air in the second area to flow in the above-mentioned second direction D2, the air cutting noise by the air suction fan 43 can be reduced with a simple structure.

Now, as shown in FIGS. 11 and 12, in the second area R2, the ribs 71 are provided two or more in number; and the number of ribs 71 on the outer peripheral side of the rotation area, which is a round area to be formed due to the rotation of the vane portion 43*b* of the air suction fan 43, is set larger than the number thereof on the central side of such rotation area. That is, the number of the change routes F2 on the outer peripheral side of the rotation area is set larger than the number on the central portion of the rotation area.

In the air suction fan 43, the linear velocity on the outer peripheral side of the rotation area is faster than that on the central side thereof, and thus the flow speed of the air increases on the outer peripheral side over the central side. Therefore, the air cutting noise is easier to occur on the outer peripheral side. In view of this, when the number of the change routes F2 is set larger on the outer peripheral side than on the central side, the quantities of the air to be changed in the second direction D2 are increased more, thereby being able to reduce the air cutting noise further.

Here, as described above, in the second guide unit 62, the introduction route F1 is formed by the louver 51 which guides the air in the first direction D1, and the change route F2 is formed by the rib 71 which guides the direction of the air guided in the first direction D1 by the introduction route F1 of the louver 51 into the second direction D2. As shown specifically in FIG. 10, according to the present exemplary embodiment, the length of the change route F2 is set larger than the length of the introduction route F1.

When the length of the introduction route F1 is larger than the length of the change route F2, the direction of the air may not be changed from the first direction D1 to the second direction D2 but the air may pass through the change route F2 (while it is being changed in direction). In this case, the reduction in the air cutting noise becomes unstable.

In view of this, as shown in FIG. 10, when the length of the change route F2 is set larger than the length of the introduction route F1, the direction of the air introduced into the introduced route F1 can be positively changed to the second direction D2, whereby the air cutting noise can be reduced stably.

As shown in FIGS. 9 and 10, according to the present exemplary embodiment, the louver 51 is provided such that it is inclined upwardly toward the air suction fan 43 and thus the first direction D1, which is regulated by the louver 51, provides a direction in which the air is guided upwardly from below.

When the louver 51 is so formed to be inclined upwardly toward the introduction direction of the air, foreign matter or dust is hard to go into the inside of the box unit.

Here, as shown in FIGS. 11 and 12, on the air suction fan 43 side of the louvers 51 constituting the guide unit 60, there are arranged ribs (dividing members) 72 for dividing the air that is guided by the air suction fan 43.

At the position of the air suction fan 43, the air is taken directly into the air suction fan 43, whereas, at the position of the plate 52 fitted into the periphery of the air suction fan 43, the air is changed greatly in direction to a route along the plate 52 and is then guided to the air suction fan 43 from laterally of the air suction fan 43. And, in the portion where the direction of the air is changed greatly, the current of the air is disturbed (that is, there is generated a turbulent flow), thereby causing the air cutting noise.

Accordingly, owing to provision of the ribs 72 shown in FIGS. 11 and 12, the turbulence of the air can be restricted, thereby being able to reduce the generation of the air cutting noise.

Figure 18:
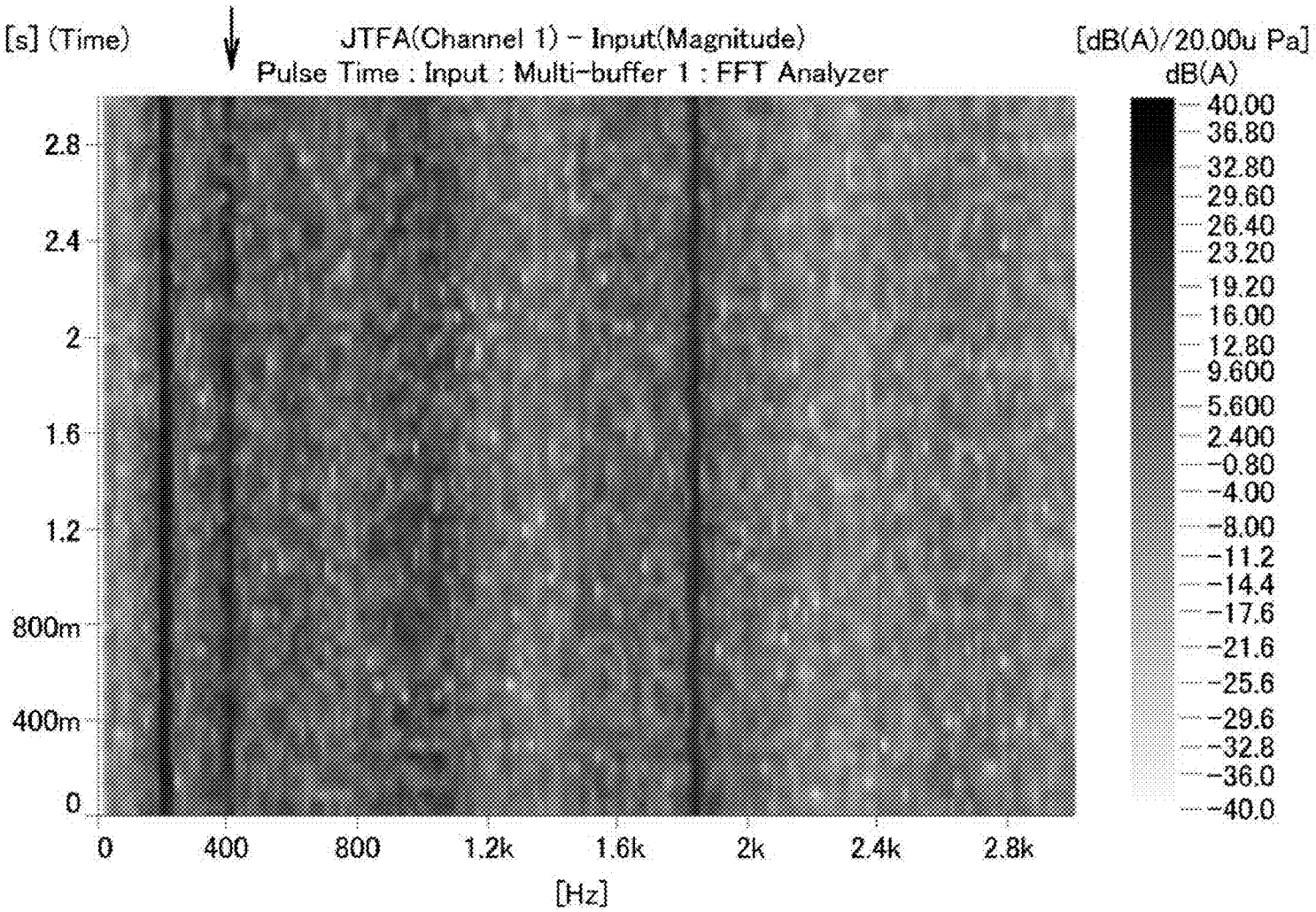
FIG. 18 is an explanatory view of the measured results of air cutting noises generated by an air suction fan according to an air guide mechanism serving as a comparison example.
Figure 19:
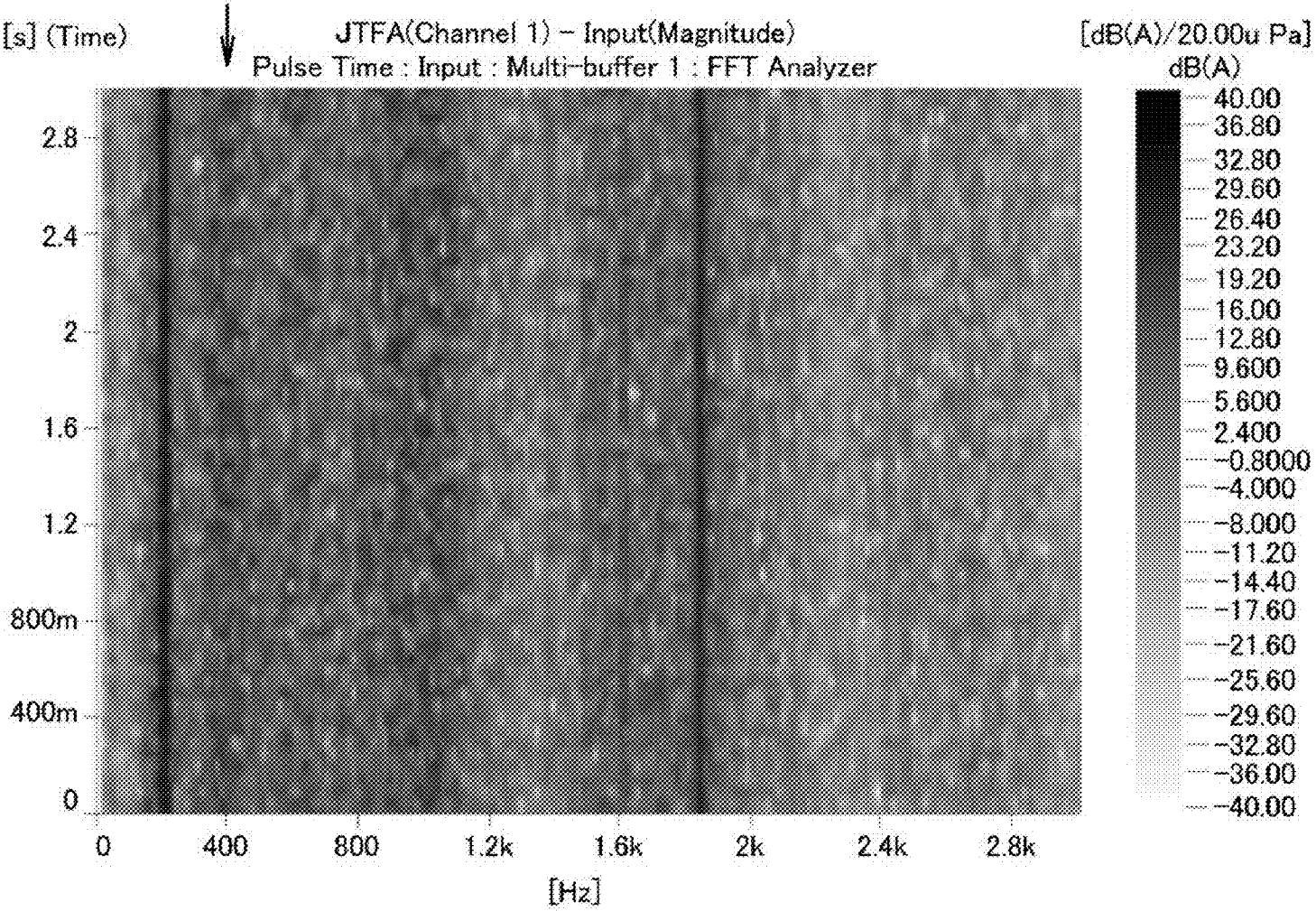
FIG. 19 is an explanatory view of the measured results of air cutting noises generated by an air suction fan according to an air guide mechanism according to the present exemplary embodiment.

Here, FIG. 18 shows the measured results of the air cutting noise generated by the air suction fan 43 used in the air guide mechanism (see FIGS. 14 and 15) serving as a comparison example structured such that the air in both of the first and second areas R1 and R2 is introduced from the first direction D1. Also, FIG. 19 shows the measured results of the air cutting noise generated by the suction fan 43 employed in the air guide mechanism according to the present exemplary embodiment in which the air in the first area R1 is introduced from the first direction D1, the air in the second area R2 is introduced from the second direction D2 (see FIGS. 14 and 16), and there are provided the ribs 72 serving as dividing members.

Here, the first direction D1 is set at 45 degrees with respect to the above-mentioned virtual plane Z, the second direction D2 is set substantially at right angles with respect to the virtual plane Z, the diameter of the air suction fan 43 is set for 9 cm, the number of vane portions 43*b* is set for 7, the inclination angle of each of the vane portions 43*b* is set at about 30 degrees, and the number of rotations of the fan is set for 1700 per minute. Also, referring to measuring instruments used, a microphone is "BRYUEL CARE" 4190, and an analyzer is "BRYUEL CARE" PULSE SYSTEM Ver9. For a measuring environment, there is used a hemi-non-acoustic room having a length of 9 m, a width of 6 m and a height of 4.05 m.

As shown in these drawings, in the air guide mechanism according to the present exemplary embodiment, the volume of noise in the vicinity of a 400 Hz band, which is found in the air guide mechanism according to the comparison example, is reduced.

In the foregoing description, the first direction D1 is a direction in which the air flows upwardly from below and the second direction D2 is a direction which is substantially perpendicular to the virtual plane Z. However, according to the invention, the first and second directions D1 and D2 are not limited to these directions.

In other words, for the first direction D1, by setting the louver such that it faces in the opposite direction to the above-mentioned direction, the first direction D1 may also be set for a direction in which the air is guided downwardly from above; or, by providing the louver in such a manner that it is long in the vertical direction, it may also be set for a direction in which the air is guided obliquely laterally. Here, since the first area R1 is an area in which the first direction D1 has an acute angle with respect to the inclination direction of the vane portion 43*b*, when the first direction D1 is a direction for guiding the air upwardly from below, when it is a direction for guiding the air downwardly from above, and when it is a direction for guiding the air obliquely laterally, the position of the first area R1 differs accordingly and also the position of the first guide portion set to correspond to the first area R1 differs as well. That is, suppose the rotation direction of the air suction fan 43 is the same as in the present exemplary embodiment, when the first direction D1 is a direction going downwardly from above, the first area R1 provides the right side of the rotation area of the air suction fan 43; and, when the first direction D1 is a direction going obliquely laterally, the first area R1 provides the upper or lower side of the rotation area of the air suction fan 43. Here, the second area R2 may be all of other areas than the first area R1, or it may also be a portion of other areas than the first area R1.

Figure 20:
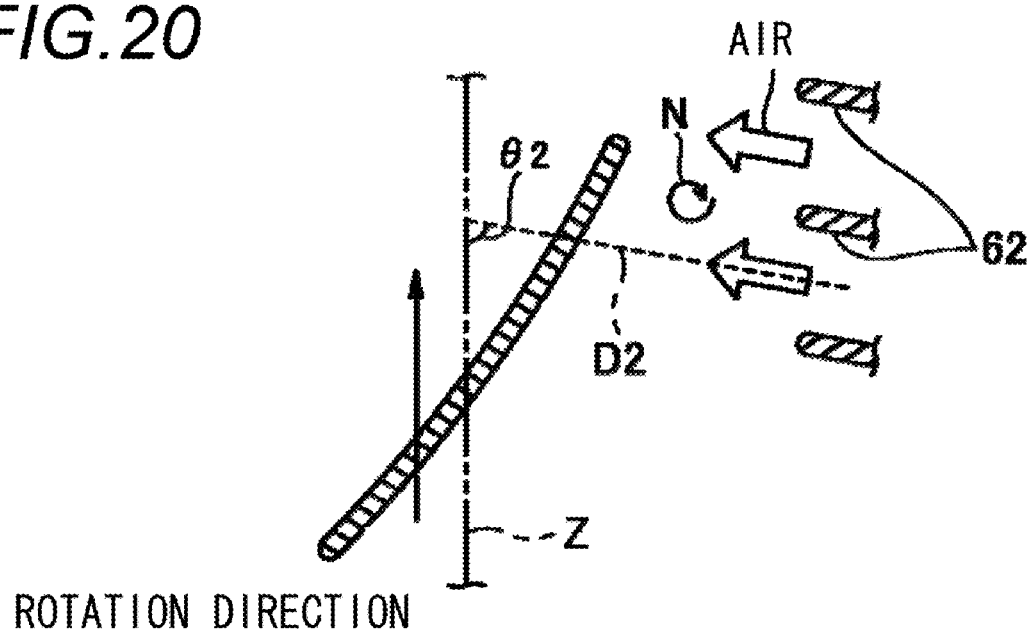
FIG. 20 is an explanatory view of a second direction according to a first modification of the present exemplary embodiment.
Figure 21:
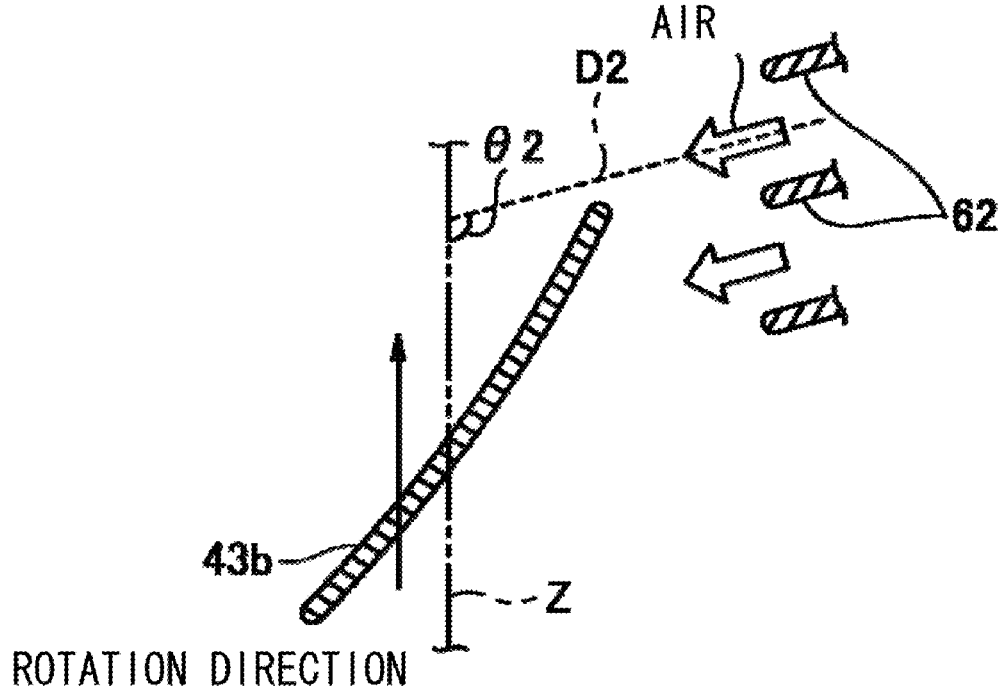
FIG. 21 is an explanatory view of a second direction according to a second modification of the present exemplary embodiment.
Figure 22:
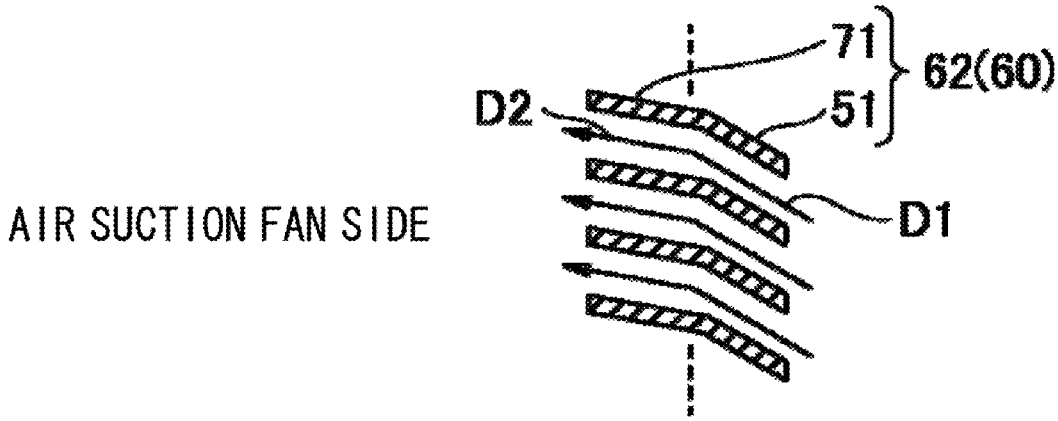
FIG. 22 is a view of the structure of a second guide portion for realizing the second direction according to the first modification of the present exemplary embodiment.
Figure 23:
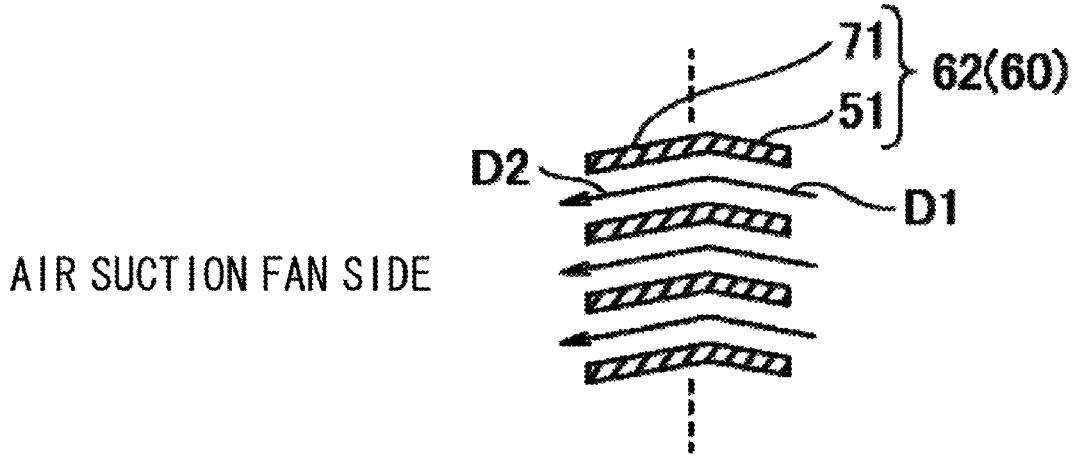
FIG. 23 is a view of the structure of a second guide portion for realizing the second direction according to the second modification of the present exemplary embodiment.

For the second direction D2 as well, it may be an air direction in which the air cutting noise generated by the rotation of the air suction fan 43 can be reduced over the first direction D1. Thus, the second direction D2 may be the direction that can provide an angle θ2, which is larger than an angle θ1 provided by the acute angle side of the first direction D1 with respect to the virtual plane Z, on the same side thereof as the acute angle side. For the relationship with the inclination direction of the vane portion 43*b*, the second direction D2 may be a direction that provides a smaller angle than a non-acute angle at which the first direction D1 intersects with the inclination direction of the vane portion 43*b*. In other words, as shown in FIG. 20, the angle θ2 provided between the second direction D2 and virtual plane Z may be an acute angle, or as shown in FIG. 21, it may be an obtuse angle. Here, FIG. 22 shows the louver 51 and rib 71 of the second guide portion 62 when the angle θ2 is an acute angle, while FIG. 23 shows the louver 51 and rib 71 of the second guide portion 62 when the angle θ2 is an obtuse angle.

Also, in the present exemplary embodiment, in the first area R1, the first direction D1 with respect to the inclination direction of the vane portion 43*b* may only be an acute angle, and any acute angle may be employed.

Figure 24:
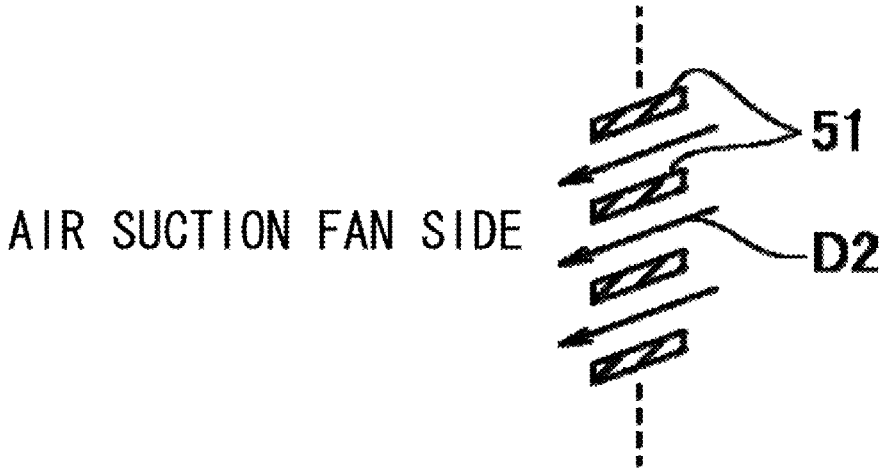
FIG. 24 is a view of the structure of a second guide portion for realizing the second direction according to a third modification of the present exemplary embodiment.
Figure 25:
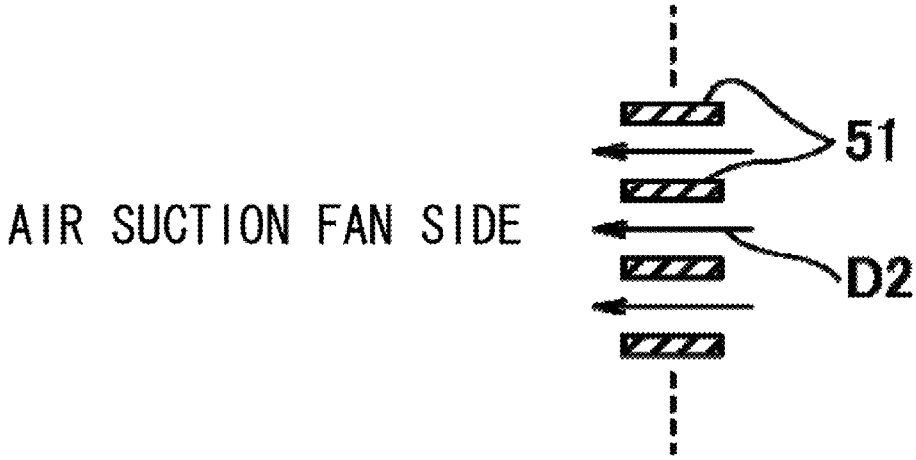
FIG. 25 is a view of the structure of a second guide portion for realizing the second direction according to a fourth modification of the present exemplary embodiment.

Also, in the foregoing description, the first direction D1 is realized by the louver 51, while the second direction D2 is realized by the louver 51 and rib 71. However, the first and second directions D1 and D2 may both be realized using only the louver 51. That is, for example, the first direction D1 may be realized by the louver 51 shown in FIG. 9 and, as shown in FIGS. 24 and 25, the second direction D2 may be realized by the louver 51 the direction of which is different from that shown in FIG. 9.

In the foregoing description, there is illustrated an example in which an air guide mechanism according to the invention is applied to an image forming apparatus. However, the invention may also be widely applied, besides the image forming apparatus, to various kinds of apparatus (for example, a personal computer) including an air suction fan for introduction of the air for cooling heating elements incorporated in a box unit.

Therefore, the heating element is not limited to the heating elements of an image forming apparatus but it includes various heating elements incorporated within an apparatus to which the invention is applied.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An air guide mechanism, comprising:

a box unit that incorporates a heating element therein;

an air fan unit that is disposed within the box unit and has a vane portion which rotates to guide air; and a guide unit that is disposed on a side of the box unit against the air fan unit, wherein the guide unit guides the air to a portion of a round area formed due to the rotation of the vane portion from a first direction having an acute angle with respect to an inclination direction of the vane portion corresponding to the portion of the round area, and to an area, which is at least another portion of the round area and in which the first direction intersects at a non-acute angle with an inclination direction of the vane portion, from a second direction having a smaller angle than the non-acute angle.

2. The air guide mechanism according to claim 1, wherein the first direction is a direction in which the air is guided upwardly from below.

3. The air guide mechanism according to claim 1, further comprising a dividing member that is disposed on the guide unit toward a side of the air fan unit for dividing the air guided to the air fan unit from the side of the air fan unit.

4. An image forming apparatus that forms an image on a recording member, comprising;

an air guide mechanism according to claim 1.

5. An air guide mechanism, comprising:

a box unit that incorporates a heating element therein;

an air fan unit that is disposed within the box unit and has a vane portion which rotates to guide air; and, a guide unit that is disposed on a side of the box unit against the air fan unit, wherein the guide unit includes:

a first guide portion that guides the air to a portion of a round area formed due to the rotation of the vane portion from a first direction having an acute angle with respect to an inclination direction of the vane portion corresponding to the portion of the round area; and a second guide portion that that guides the air to an area which is at least another portion of the round area and in which the first direction intersects at a non-acute angle with an inclination direction of the vane portion from a second direction having a smaller angle than the non-acute angle.

6. The air guide mechanism according to claim 5, wherein the first guide portion has an introduction route for introducing the air toward the first direction, and the second guide portion has a change route for changing a current of the air introduced toward the first direction to the second direction.

7. The air guide mechanism according to claim 6, wherein the change route includes a plurality of change routes, the number of the plurality of change routes are larger on an outer peripheral side of the round area formed due to the rotation of the vane portion than on a central side of the round area.

8. The air guide mechanism according to claim 6, wherein at least one change routes is larger in length than the introduction route.

* * * * *